US007132153B2

(12) United States Patent
Zackrisson et al.

(10) Patent No.: US 7,132,153 B2
(45) **Date of Patent: *Nov. 7, 2006**

(54) COATED CUTTING TOOL INSERT FOR MACHINING OF CAST IRONS

(75) Inventors: Jenni Zackrisson, Fagersta (SE); Sakari Ruppi, Fagersta (SE); Andreas Larsson, Fagersta (SE)

(73) Assignee: Seco Tools AB, Fagersta (SE)

( * ) Notice: Subject to any disclaimer, the term of this patent is extended or adjusted under 35 U.S.C. 154(b) by 161 days.

This patent is subject to a terminal disclaimer.

(21) Appl. No.: 10/807,341

(22) Filed: Mar. 24, 2004

(65) Prior Publication Data

US 2004/0265648 A1 Dec. 30, 2004

(30) Foreign Application Priority Data

Mar. 24, 2003 (SE) ..... 0300781

(51) Int. Cl.
*B32B 9/00* (2006.01)

(52) U.S. Cl. ..... 428/216; 31/307; 31/309; 428/336; 428/472; 428/698; 428/701

(58) Field of Classification Search ..... 428/216, 428/336, 472, 698, 701; 51/307, 309
See application file for complete search history.

(56) References Cited

U.S. PATENT DOCUMENTS

| | | | |
|---|---|---|---|
| 4,277,283 | A | 7/1981 | Tobioka et al. |
| 4,548,786 | A | 10/1985 | Yohe |
| 4,610,931 | A | 9/1986 | Nemeth et al. |
| 5,786,069 | A | 7/1998 | Ljungberg et al. |
| 5,945,207 | A | 8/1999 | Kutscher et al. |
| 6,200,671 | B1 | 3/2001 | Lindskog et al. |
| 6,333,100 | B1 | 12/2001 | Palmqvist et al. |
| 6,406,224 | B1 | 6/2002 | Ostlund et al. |
| 2004/0197582 | A1 | 10/2004 | Larsson et al. |

FOREIGN PATENT DOCUMENTS

| | | | |
|---|---|---|---|
| EP | 0 736 615 | A2 | 10/1996 |
| EP | 0 753 603 | A2 | 1/1997 |
| EP | 1 205 569 | A2 | 5/2002 |
| EP | 1 347 076 | A1 | 9/2003 |
| EP | 1 352 697 | A2 | 10/2003 |
| EP | 1 469 101 | A2 | 10/2004 |
| WO | 2005/028147 | A1 | 3/2005 |
| WO | 2005/028149 | A1 | 3/2005 |

*Primary Examiner*—Archene Turner
(74) *Attorney, Agent, or Firm*—Drinker Biddle & Reath LLP

(57) ABSTRACT

The present invention concerns a coated cemented carbide cutting tool insert particularly useful for turning of cast irons. The cutting tool insert is characterized by a cemented carbide body comprising WC, cubic carbonitrides, a W-alloyed Co binder phase, a surface zone of the cemented carbide body that is binder phase enriched and nearly free of cubic carbonitride phase, and a coating including an innermost layer of $TiC_xN_yO_z$ with equiaxed grains, a layer of $TiC_xN_yO_z$ with columnar grains and at least one layer of $Al_2O_3$.

19 Claims, 1 Drawing Sheet

COATED CUTTING TOOL INSERT FOR MACHINING OF CAST IRONS

BACKGROUND OF THE INVENTION

The present invention concerns a coated cemented carbide cutting tool insert particularly useful for turning of cast irons. The insert has a body with a tough Co binder phase, WC and cubic carbonitrides as hard phases, and a wear resistant coating. The surface zone of the insert body is of a different elemental composition than the bulk composition, yielding simultaneously good wear resistance, plastic deformation resistance and edge toughness.

Coated cemented carbide inserts with binder phase enriched surface zones are used for machining of steel and stainless steel materials. The binder phase enriched surface zone widens the application area towards tougher cutting operations. In inserts for turning of cast irons these cemented carbide grades have usually not shown good performance. Cemented carbide grades dedicated for machining of cast irons have traditionally been designed with low Co content, small WC grain size, and no or very small additions of cubic carbides, for the reason of WC grain growth inhibition only. Such cutting tool materials have relatively high room temperature hardness, fair crack propagation resistance and bulk toughness properties. However, in difficult applications demanding a high amount of toughness due to non-continuous cuts or more difficult to machine cast irons, the traditional grades are too brittle, resulting in edge chipping or insert breakage, one consequence being a lower productivity due to the need to use more moderate cutting data.

The cemented carbides in the traditional grades for machining cast irons sometimes have limited plastic deformation resistance, and in some operations also limited wear resistance. To improve these properties, a decrease of the WC grain size and lowering of the Co binder phase content and/or an increased addition of cubic carbonitride forming elements is needed. Each of these changes decreases the insert toughness.

Methods to improve the toughness behavior by introducing an essentially cubic carbide free and binder phase enriched surface zone are known. U.S. Pat. Nos. 4,277,283, 4,610,931 and 4,548,786 describe methods to accomplish binder phase enrichment in the surface region by dissolution of cubic carbide phase close to the insert surfaces. The methods require that the cubic carbide phase contains some nitrogen, since dissolution of cubic carbide phase at the sintering temperature requires a partial pressure of nitrogen, nitrogen activity within the body being sintered exceeding the partial pressure of nitrogen within the sintering atmosphere. The nitrogen can be added through the furnace atmosphere during the sintering cycle and/or directly through the powder. The dissolution of cubic carbide phase, preferentially in the surface region, results in small volumes that will be filled with binder phase giving the desired binder phase enrichment. As a result, a surface zone consisting of essentially WC and binder phase is obtained.

U.S. Pat. No. 6,333,100 relates to a coated cemented carbide insert for turning of steels. The insert has a highly alloyed Co-binder phase, from about 4 to about 12, preferably from about 7 to about 10, percent by weight of cubic carbides and a WC grain size of from about 1 to about 4, preferably from about 2 to about 3 μm. The binder phase enriched surface zone is of a thickness <20 μm and along a line in the direction from the edge to the center of the insert the binder phase content increases essentially monotonously until it reaches the bulk composition. The coating of the insert comprises from about 3 to about 12 μm of columnar TiCN and from about 2 to about 12 μm of $Al_2O_3$.

U.S. Pat. No. 5,945,207 describes a cutting tool insert particularly useful for cutting of cast iron materials. The insert is characterised by a WC—Co cemented carbide body with from about 5 to about 10 wt. % Co and <0.5% cubic carbides from groups IVb, Vb or VIb of the periodic table. The binder phase is highly W-alloyed and the surface composition is well defined. The coating comprises a layer of $TiC_xN_yO_z$ with columnar grains, a layer of fine-grained textured $\alpha$-$Al_2O_3$ and a top layer of $TiC_xN_yO_z$ that has been removed along the edge line.

SUMMARY OF THE INVENTION

In one aspect of the invention, there is provided a cutting tool insert particularly useful for turning of cast irons comprising a cemented carbide body and a coating, said body having a composition of from about 3.0 to about 9.0 wt. % Co, from about 4.0 to about 10.0 wt. % of cubic carbonitride forming elements from groups IVb and Vb of the periodic table, N, C, and WC, and a from about 5 to about 50 μm thick surface zone, which is binder phase enriched and nearly free of cubic carbonitride phase, with a maximum binder phase content in the surface zone of from about 1.2 to about 3 by volume of the bulk binder phase content, said coating comprising:

a first, innermost layer of $TiC_xN_yO_z$ with $0.7 \leqq x+y+z \leqq 1$ with equiaxed grains and a total thickness <2 μm;

a layer of $TiC_xN_yO_z$ with $0.7 \leqq x+y+z \leqq 1$ with a thickness of from about 3 to about 14 μm with columnar grains; and at least one layer of $Al_2O_3$ with a thickness of from about 2 to about 14 μm.

DESCRIPTION OF FIGURE

FIG. 1 shows in 1000× the structure of the cutting tool insert according to the invention in which:

Figure 1:
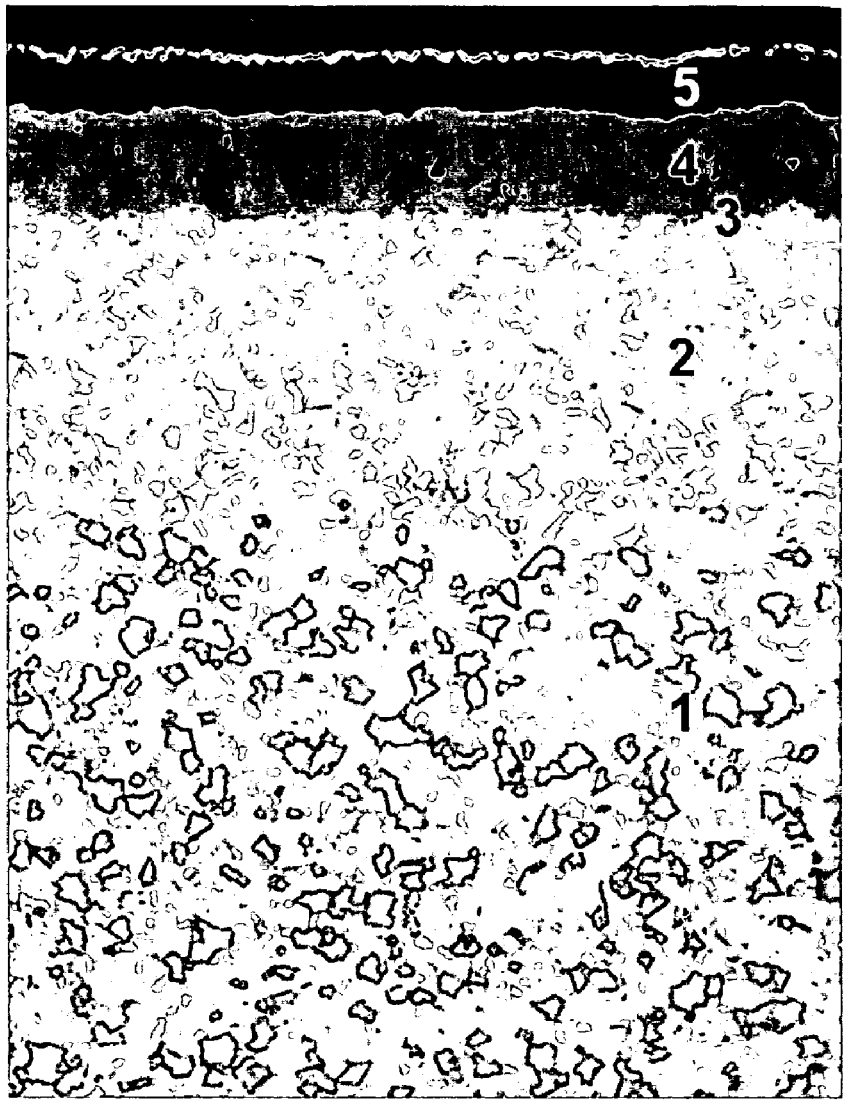

1. Cemented carbide bulk
2. Cemented carbide surface zone
3. An innermost $TiC_xN_yO_z$ layer
4. A second $TiC_xN_yO_z$ layer
5. An $Al_2O_3$ layer

DETAILED DESCRIPTION OF INVENTION OF THE INVENTION

Surprisingly, it has now been found that improved performance when machining cast iron under difficult conditions can be obtained by a combination of many different features of the cutting tool insert. More specifically, it has been found that improvements with respect to edge strength, plastic deformation and wear resistance can simultaneously be obtained if the tool is manufactured such that a binder phase enriched, nearly cubic carbonitride free, surface zone is combined with a low Co binder content, a well defined WC grain size, and an addition of cubic carbonitride forming elements.

In combination with a hard wear resistant coating, said cutting tool insert shows excellent performance for turning cast irons in difficult operations. The unique properties of the tool allow a higher productivity to be maintained for a wider application area.

According to the present invention, a coated cutting tool is provided with a cemented carbide body having a composition of from about 3.0 to about 9.0 wt. %, preferably from about 4.0 to about 7.0 wt. % Co, from about 4.0 to about 10.0 wt. %, preferably from about 6.0 to about 9.0 wt. % of cubic carbonitride forming elements from groups IVb and Vb of the periodic table, N, C and WC. N is present in the sintered body in an amount corresponding to >1.0%, preferably from about 1.7 to about 5.0%, of the weight of the elements from groups IVb and Vb.

The cemented carbide has a from about 5 to about 50 μm, preferably from about 10 to about 40 μm, thick surface zone, which is binder phase enriched and nearly free of cubic carbonitride phase. The maximum binder phase content of the surface zone is from about 1.2 to about 3 by volume of the bulk binder phase content.

The cobalt binder phase is medium to highly alloyed with tungsten. The content of tungsten in the binder phase may be expressed as the S-value=σ/16.1, where σ is the measured magnetic moment of the binder phase in $\mu Tm^3\ kg^{-1}$. The S-value depends on the tungsten content of the binder phase and increases with a decreasing tungsten content. Thus, for pure cobalt, or a binder that is saturated with carbon, S=1, and for a binder phase with a tungsten content corresponding to the borderline to η-phase formation, S=0.78.

It has now been found according to the present invention that improved cutting performance is achieved if the cemented carbide body has an S-value within the range from about 0.78 to about 0.95, preferably from about 0.80 to about 0.92.

Furthermore the mean intercept length of the tungsten carbide phase measured on a ground and polished representative cross section is in the range from about 0.50 to about 0.95 μm, preferably from about 0.60 to about 0.85. The mean intercept length of the cubic carbonitride phase is essentially the same as for tungsten carbide. The intercept length is measured by means of image analysis on micrographs with a magnification of 10000× and calculated as the average mean value of approximately 1000 intercept lengths.

In a preferred embodiment, the amount of cubic carbonitrides corresponds to from about 4.0 to about 10.0% by weight of the cubic carbonitride forming elements titanium, tantalum and niobium, preferably from about 6.0 to about 9.0% by weight. The ratio between tantalum and niobium is within from about 0.8 to about 4.5 by weight, preferably from about 1.2 to about 3.0 by weight. The ratio between titanium and niobium is within from about 0.5 to about 7.0 by weight, preferably from about 1.0 to about 4.0 by weight.

The cutting tool insert according to the invention has a coating comprising:

- a first, innermost layer of $TiC_xN_yO_z$ with $0.7 \leqq x+y+z \leqq 1$, preferably $z \leqq 0.5$, more preferably y>x and z<0.2, most preferably y>0.7, with equiaxed grains and a total thickness <2 μm preferably >0.1 μm.
- a layer of $TiC_xN_yO_z$ with $0.7 \leqq x+y+z \leqq 1$, preferably with z<0.2, x>0.3 and y>0.2, most preferably x>0.4, with a thickness of from about 3 to about 14 μm, preferably from about 4 to about 12 μm, most preferably from about 5 to about 10 μm, with columnar grains.
- at least one layer of $Al_2O_3$, preferably $\alpha$-$Al_2O_3$, with a thickness of from about 2 to about 14 μm, preferably from about 3 to about 10 μm.
- the outer layer of $Al_2O_3$ can be followed by further layers of $TiC_xN_yO_z$, $HfC_xN_yO_z$ or $ZrC_xN_yO_z$ or mixtures thereof with $0.7 \leqq x+y+z \leqq 1.2$, preferably with y>x and z<0.4, more preferably y>0.4, most preferably y>0.7, with thickness <3 μm, preferably from about 0.4 to about 1.5 μm, but the $Al_2O_3$ layer can also be the outermost layer.

Production of the cemented carbide body according to the invention is done in either of two ways or a combination thereof: (i) by sintering a presintered or compacted body containing a nitride or a carbonitride in an inert atmosphere or in vacuum as disclosed in U.S. Pat. No. 4,610,931; or (ii) by nitriding the compacted body as disclosed in U.S. Pat. No. 4,548,786 followed by sintering in an inert atmosphere or in vacuum.

The desired mean intercept length depends on the grain size of the starting powders and milling and sintering conditions and has to be determined by experiments. The desired S-value depends on the starting powders and sintering conditions and also has to be determined by experiments.

The layer of $TiC_xN_yO_z$ with $0.7 \leqq x+y+z \leqq 1$, preferably with z<0.2, x>0.3 and y>0.2, most preferably x>0.4, having a morphology of columnar grains, is deposited with MTCVD-technique onto the cemented carbide using acetonitrile as the carbon and nitrogen source for forming the layer in the temperature range of from about 700 to about 950° C.

The innermost $TiC_xN_yO_z$ layer, the $Al_2O_3$ layers and subsequent $TiC_xN_yO_z$, $HfC_xN_yO_z$ or $ZrC_xN_yO_z$ layers are deposited according to known techniques.

The invention also relates to the use of cutting tool inserts according to the above for turning in cast irons at cutting speeds of from about 100 to about 700 m/min, preferably from about 100 to about 600 m/min, with feed values of from about 0.04 to about 1.0 mm/rev., depending on cutting speed and insert geometry.

The invention is additionally illustrated in connection with the following Examples, which are to be considered as illustrative of the present invention. It should be understood, however, that the invention is not limited to the specific details of the Examples.

EXAMPLE 1

Grade A: A cemented carbide substrate in accordance with the invention with the composition 5.3 wt % Co, 3.3 wt % Ta, 2.1 wt % Nb, 2.0 wt % Ti, 6.0 wt % C, 0.2 wt % N and balance W, with a binder phase alloyed with W corresponding to an S-value of 0.89 was produced by conventional milling of powders, pressing of green compacts and subsequent sintering at 1430° C. Investigation of the microstructure after sintering showed that the mean intercept length of the tungsten carbide phase was 0.71 μm and that the surface zone of the inserts consisted of a 25 μm thick binder phase enriched part nearly free of cubic carbonitride phase. The substrate was coated in accordance with the invention with subsequent layers deposited during the same coating cycle. The first layer was a 0.2 μm thick $TiC_xN_yO_z$ layer with z<0.1 and y>0.6, having equiaxed grains. The second layer was 6.9 μm of columnar $TiC_xN_yO_z$ deposited at from about 835 to about 850° C. with acetonitrile as carbon and nitrogen source, yielding an approximated carbon to nitrogen ratio x/y=1.5 with z<0.1. A 4.5 μm thick layer of $Al_2O_3$, consisting of the α-phase, was deposited at approximately 1000° C. An outer layer of equiaxed nitrogen rich $TiC_xN_yO_z$ with z<0.1 and y>0.8 was deposited to a thickness of 0.4 μm.

Grade B: A cemented carbide substrate in accordance with the invention with the composition 5.6 wt % Co, 1.0 wt % Ta, 0.6 wt % Nb, 1.9 wt % Ti, 6.01 wt % C, 0.13 wt % N, balance W, with a binder phase alloyed with W corresponding to an S-value of 0.89 was produced in the same way as Grade A. The mean intercept length of the tungsten carbide phase after sintering was 0.56 μm and the surface zone of the inserts consisted of a 20 μm thick binder phase enriched part nearly free of cubic carbonitride phase. The substrate was coated according to Grade A.

Grade C: A conventional cemented carbide substrate designed for cast iron machining, with the composition 6.0 wt % Co, 0.16 wt % Ta, 5.80 wt % C and balance W, a binder phase alloyed with W corresponding to an S-value of 0.94, and a mean intercept length of WC in the sintered body of 0.61 μm was combined with a coating according to Grade A (according to the invention).

Grade D: A substrate with average composition 5.5 wt % Co, 1.5 wt % Ta, 1.3 wt % Nb, 5.86 wt % C and balance W, having no cubic carbonitride free surface zone, a binder phase alloyed with W corresponding to an S-value of 0.89, and a mean intercept length of WC in the sintered body of 0.57 μm was combined with a coating according to Grade A.

Grade E: A commercial cemented carbide grade for cast iron machining in which a substrate according to Grade C is combined with a coating consisting of: a first thin layer of $TiC_xN_yO_z$; a second layer of columnar $TiC_xN_yO_z$ with thickness 6.2 μm; a 2.1 μm thick layer of κ-$Al_2O_3$; and an outermost 1.2 μm thick N-rich $TiC_xN_yO_z$ layer.

Grade A, Grade B, Grade C, Grade D and Grade E were tested with respect to edge toughness in the case of interrupted cuts. The machining operation was longitudinal turning of a cylindrical slotted bar.

Material: Steel SS1672
Insert type: CNMG120412-M5
Cutting speed: 140 m/min
Feed: 0.1, 0.125, 0.16, 0.20, 0.25, 0.315, 0.4, 0.5, 0.63, 0.8 mm/rev gradually increased after 10 mm length of cut
Depth of cut: 2.5 mm
Tool life criteria: Edge chipping or inserts breakage.

| Results | Mean feed at breakage (mm/rev.) |
|---|---|
| Grade A (Grade according to the invention) | 0.32 |
| Grade B (Coating according to the invention) | 0.20 |
| Grade C (Coating according to the invention) | 0.20 |
| Grade D (Coating according to the invention) | 0.15 |
| Grade E (Prior art) | 0.18 |

This test shows that combinations of the substrate and coating according to the invention exhibit equal or superior edge toughness as compared to conventional cast iron machining grades. The test also shows the detrimental effects that cubic carbonitride phase additions have on edge toughness if a gradient surface zone is not formed.

EXAMPLE 2

Inserts according to Grade A, Grade B, and Grade C were tested in facing of a pre-drilled pearlitic nodular cast iron component. The tool life criterion was chipping of the cutting edges or insert breakage.

| | |
|---|---|
| Material: | Nodular cast iron, SS0737 |
| Component: | Axially drilled cylinder |
| Insert type: | CNMG120408-MR7 |
| Cutting speed: | 200 m/min |
| Feed: | 0.35 mm/rev. |
| Depth of cut: | 1.5 mm |
| Cutting conditions: | Heavy interrupted cut |
| Coolant: | Yes |

| Results: | Number of passes |
|---|---|
| Grade A (Grade according to the invention) | 8 (minor chipping) |
| Grade B (Grade according to the invention) | 4 (severe chipping) |
| Grade C (Coating according to the invention) | 4 (insert breakage) |

EXAMPLE 3

Inserts according to Grade A, Grade C, and Grade D were tested in longitudinal turning of a nodular cast iron. The plastic deformation resistance of the different grades was investigated and compared.

| | |
|---|---|
| Material: | Nodular cast iron, SS0727 |
| Insert type: | CNMG120412-M5 |
| Cutting speed: | 350 m/min |
| Feed: | 0.4 mm/rev. |
| Depth of cut: | 2.5 mm |
| Coolant: | No |
| Time in cut: | 5 min |

| Results: | Edge depression |
|---|---|
| Grade A (Grade according to the invention) | 20 μm |
| Grade B (Coating according to the invention) | 20 μm |
| Grade C (Coating according to the invention) | 30 μm |

As is shown in this test, the plastic deformation resistance of Grade A is not impaired by the presence of the Co enriched cubic carbonitride free surface zone.

EXAMPLE 4

Inserts according to Grade A, Grade B, Grade C, and Grade E were tested in facing of a housing. The inserts were inspected after production of 20 components and the number of micro-chippings occurring along the cutting edge was counted.

| | |
|---|---|
| Material: | Nodular cast iron, SS0732 |
| Insert type: | CNMG120412-M5 |
| Cutting speed: | 250 m/min |
| Feed: | 0.35 mm/rev. |
| Depth of cut: | 2 mm |
| Coolant: | No |
| Number of components: | 20 |

| Results: | Number of micro chippings |
|---|---|
| Grade A (Grade according to the invention) | 2 |
| Grade C (Coating according to the invention) | 6 |
| Grade E (Prior art) | 8 |

This test shows the improved edge toughness reached with Grade A, the grade according to the invention.

The principles, preferred embodiments, and modes of operation of the present invention have been described in the foregoing specification. The invention, which is intended to be protected herein, however, is not to be construed as limited to the particular forms disclosed, since these are to be regarded as illustrative rather than restrictive. Variations and changes may be made by those skilled in the art without departing from the spirit of the invention.

The invention claimed is:

1. A cutting tool insert for turning of cast irons, comprising a cemented carbide body and a coating, said body having a composition of from about 3.0 to about 9.0 wt. % Co, from about 4.0 to about 10.0 wt. % of cubic carbonitride forming elements from groups IVb and Vb of the periodic table, N, C, and WC, and a from about 5 to about 50 μm thick surface zone, which is binder phase enriched and nearly free of cubic carbonitride phase, with a maximum binder phase content in the surface zone of from about 1.2 to about 3 by volume of the bulk binder phase content, said coating comprising:

a first, innermost layer of $TiC_xN_yO_z$ with $0.7 \leqq x+y+z \leqq 1$ with equiaxed grains and a total thickness <2 μm;

a layer of $TiC_xN_yO_z$ with $0.7 \leqq x+y+z \leqq 1$ with a thickness of from about 3 to about 14 μm with columnar grains; and at least one layer of $Al_2O_3$ with a thickness of from about 2 to about 14 μm.

2. The cutting tool insert of claim 1 wherein said body has a composition of from about 4.0 to about 7.0 wt. % Co, from about 6.0 to about 9.0 wt. % of cubic carbonitride forming elements from groups IVb and Vb of the periodic table and wherein:

the first, innermost layer of $TiC_xN_yO_z$ with $z<0.5$ has equiaxed grains and a total thickness >0.1 μm;

the layer of $TiC_xN_yO_z$ with $z<0.2$, $x>0.3$ and $y>0.2$ has a thickness of from about 4 to about 12 μm with columnar grains; and the at least one layer of $Al_2O_3$ a thickness of from about 3 to about 10 μm.

3. The cutting tool insert of claim 2 wherein:

the first innermost layer of $TiC_xN_yO_z$ with $y>x$ and $z<0.2$ has equiaxed grains and the total thickness <1 μm;

the layer of $TiC_xN_yO_z$ with $x>0.4$ has thickness of from about 5 to about 10 μm with columnar grains; and the at least one layer of $Al_2O_3$ has thickness of from about 3 to about 8 μm.

4. The cutting tool insert of claim 3 wherein said first innermost layer of $TiC_xN_yO_z$ has $y>0.7$.

5. The cutting tool insert of claim 1 further comprising an outer layer of $TiC_xN_yO_z$, $HfC_xN_yO_z$ or $ZrC_xN_yO_z$ or mixtures thereof with $0.7 \leqq x+y+z \leqq 1.2$ with thickness <3 μm.

6. The cutting tool insert of claim 5 wherein said outer layer of $TiC_xN_yO_z$, $HfC_xN_yO_z$ or $ZrC_xN_yO_z$ or mixtures thereof with $y>x$ and $z<0.4$ with thickness from about 0.4 to about 1.5 μm.

7. The cutting tool insert of claim 6 wherein said outer layer of $TiC_xN_yO_z$, $HfC_xN_yO_z$ or $ZrC_xN_yO_z$ or mixtures thereof has $y>0.4$.

8. The cutting tool insert of claim 7 wherein said outer layer of $TiC_xN_yO_z$, $HfC_xN_yO_z$or $ZrC_xN_yO_z$ or mixtures thereof the $y>0.7$.

9. The cutting tool insert of claim 1 wherein a S-value of the cemented carbide body is within a range from about 0.78 to about 0.95 and that a mean intercept length of the WC phase is from about 0.50 to about 0.95 μm.

10. The cutting tool insert of claim 9 wherein the S-value of the cemented carbide body is within the range from about 0.80 to about 0.92 and that the mean intercept length of the WC phase is from about 0.60 to about 0.85 μm.

11. The cutting tool insert of claim 1 wherein N is present in the sintered body in an amount corresponding to >1.0% of the weight of the elements from groups IVb and Vb of the periodic table.

12. The cutting tool insert of claim 11 wherein N is present in the sintered body in an amount corresponding to from about 1.7 to about 5.0% of the weight of the elements from groups IVb and Vb of the periodic table.

13. The cutting tool insert of claim 1 wherein the amount of cubic carbonitrides corresponds to from about 0.5 to about 4.0% by weight of the cubic carbonitride forming elements titanium, tantalum and niobium.

14. The cutting tool insert of claim 13 wherein the amount of cubic carbonitrides corresponds to from about 1.0 to about 4.0% by weight of the cubic carbonitride forming elements titanium, tantalum and niobium.

15. The cutting tool insert of claim 13 wherein a ratio between tantalum and niobium is within from about 0.8 to about 4.5 by weight and the ratio between titanium and niobium is within from about 0.5 to about 7.0 by weight.

16. The cutting tool insert of claim 15 wherein the ratio between tantalum and niobium is within from about 1.2 to about 3.0 by weight and the ratio between titanium and niobium is within from about 1.0 to about 4.0 by weight.

17. The use of a cutting tool insert of claim 1 for turning in cast irons at cutting speeds of from about 100 to about 700 m/min with feed values of from about 0.04 to about 1.0 mm/rev., depending on cutting speed and insert geometry.

18. The use of a cutting tool insert of claim 17 for turning in cast irons at cutting speeds of from about 100 to about 600 m/min.

19. The use of the cutting tool insert of claim 17 wherein the cutting speed is from about 100 to about 600 m/min.

* * * * *